United States Patent [19]

Davidson et al.

[11] Patent Number: 4,868,867

[45] Date of Patent: Sep. 19, 1989

[54] VECTOR EXCITATION SPEECH OR AUDIO CODER FOR TRANSMISSION OR STORAGE

[75] Inventors: Grant Davidson; Allen Gersho, both of Goleta, Calif.

[73] Assignee: Voicecraft Inc., Goleta, Calif.

[21] Appl. No.: 35,518

[22] Filed: Apr. 6, 1987

[51] Int. Cl.[4] ..... G10L 3/02

[52] U.S. Cl. ..... 381/36; 381/31; 381/35

[58] Field of Search ..... 381/20–40, 381/50; 340/347 DD

[56] References Cited

U.S. PATENT DOCUMENTS

| | | | |
|---|---|---|---|
| 2,938,079 | 5/1960 | Flanagan | 381/50 |
| 4,472,832 | 9/1984 | Atal et al. | 381/40 |
| 4,720,861 | 1/1988 | Bertrand | 381/36 |
| 4,727,354 | 2/1988 | Lindsay | 340/347 DD |

OTHER PUBLICATIONS

Wong et al., "An 800 bit/s. Vector Quantization LPC Vocoder", IEEE Trans. on ASSP, vol. ASSP-30, No. 5, Oct. 1982.

Linde, et al., "An Algorithm for Vector Quantizer Design," IEEE Transactions on Communications, vol. Com-28, No. 1, Jan. 1980.

Flanagan, et al., "Speech Coding," IEEE Transactions on Communications, vol. Com-27, No. 4, Apr. 1979.

M. R. Schroeder and B. S. Atal, "Code-Excited Linear Prediction (CELP): High-Quality Speech at Very Low Bit Rates," Proc. Int'l. Conf. Acoustics, Speech, Signal Proc., Tampa, Mar. 1985.

Manfred R. Schroeder, "Predictive Coding of Speech: Historical Review and Directions for Future Research," ICASSP 86, Tokyo.

Trancoso, et al., "Efficient Procedures for Finding the Optimum Innovation in Stochastic Coders," ICASSP 86, Tokyo.

N. S. Jayant and P. Noll, "Digital Coding of Waveforms," Prentice-Hall Inc., Englewood Cliffs, N.J., 1984, pp. 10–11, 500–505.

J. Makhoul, S. Roucos and H. Gish, "Vector Quantization in Speech Coding," Proc. IEEE, vol. 73, No. 11, Nov. 1985.

T. Berger, "Rate Distortion Theory," Prentice-Hall Inc., Englewood Cliffs, N.J., pp. 147–151, 1971.

(List continued on next page.)

*Primary Examiner*—Gary V. Harkcom
*Assistant Examiner*—David D. Knepper
*Attorney, Agent, or Firm*—Hornbaker Rosen & Fernandez Frelich

[57] ABSTRACT

A vector excitation coder compresses vectors by using an optimum codebook designed off line, using an initial arbitrary codebook and a set of speech training vectors exploiting codevector sparsity (i.e., by making zero all but a selected number of samples of lowest amplitude in each of N codebook vectors). A fast-search method selects a number $N_c$ of good excitation vectors from the codebook, where $N_c$ is much smaller than N, and uses only the $N_c$ vectors in an exhaustive search for the best match between a perceptually weighted input vector $z_n$, and an estimate $\hat{z}_n$ derived from a codebook vector processed through long-term and short-terms filters, and a perceptual weighting filter. The zero input response of these cascaded filters is calculated and subtracted from an input speech vector $s_n$ after perceptual weighting to produce a vector $r_n$. The codebook search operation is performed using $$\frac{(z^T H c_j)^2}{\| H c_j \|^2} \approx \frac{(v^T c_j)^2}{R_{hh}(O)\, R^j_{cc}(O) + 2 \sum_{i=1}^{k-1} R_{hh}(i)\, R^j_{cc}(i)},$$

by calculating the numerator of a fast inner product and calculating the denominator by a fast inner product for each codebook vector $c_j$, computing the right hand side of the equation once per frame, and then cross multiplying the numerators and denominators to determine if $N_2/D_2$ is less than $N_1/D_1$ by determining if $N_1D_2 > N_2D_1$. If not $N_2$ and $D_2$ replace $N_1$ and $D_1$ in registers $E_n$ and $E_d$.

12 Claims, 6 Drawing Sheets

OTHER PUBLICATIONS

B. S. Atal and M. R. Schroeder, "Adaptive Predictive Coding of Speech Signals," Bell Syst. Tech. J., vol. 49, pp. 1973–1986, Oct. 1970.

B. S. Atal and M. R. Schroeder, "Predictive Coding of Speech Signals and Subjective Error Criteria," IEEE Trans. Acoust., Speech, Signal Proc., vol. ASSP-27, No. 3, pp. 247–254, Jun. 1979.

B. S. Atal, "Predictive Coding of Speech at Low Bit Rates," IEEE Trans. Comm., vol. COM-30, No. 4, Apr. 1982.

V. Cuperman and A. Gersho, "Vector Predictive Coding of Speech at 16 kb/s," IEEE Trans, Comm., vol. Com-33, pp. 685–696, Jul. 1985.

M. R. Schroeder, B. S. Atal and J. L. Hall, "Optimizing Digital Speech Coders by Exploiting Masking Properties of the Human Ear," J. Acoust. Soc. Am., vol. 66, No. 6, pp. 1647–1652.

J. L. Flanagan, *Speech Analysis, Synthesis, and Perception,* Academic Press, pp. 367–370, New York, 1972.

V. Ramamoorthy and N. S. Jayant, "Enhancement of ADPCM Speech by Adaptive Postfiltering," AT&T Bell Labs Tech. J., pp. 1465–1475, Oct. 1984.

N. S. Jayant and V. Ramamoorthy, "Adaptive Postfiltering of 16 kb/s-ADPCM Speech," Proc. ICASSP, pp. 829–832, Tokyo, Japan, Apr. 1986.

M. Copperi and D. Sereno, "CELP Coding for High--Quality Speech at 8 kbits/s," Proceedings Int'l. Conference on Acoustics, Speech, and Signal Processing, Tokyo, Apr. 1986.

B. S. Atal and J. R. Remde, "A New Model of LPC Excitation for Producing Natural-Sounding Speech at Low Bit Rates," Proc. Int'l. Conf. on Acoustics, Speech, and Signal Processing, Paris, May 1982.

S. Singhal and B. S. Atal, "Improving Performance of Multi-Pulse LPC Coders at Low Bit Rates," Proc. Int'l. Conf. on Acoustics, Speech and Signal Processing, San Diego, Mar. 1984.

STEP 1: SCREEN CODEVECTORS
STEP 2: REDUCED EXHAUSTIVE SEARCH

N = EXCITATION CODEBOOK SIZE
m = # OF INPUT VECTORS IN TRAINING SET

VECTOR EXCITATION SPEECH OR AUDIO CODER FOR TRANSMISSION OR STORAGE

ORIGIN OF INVENTION

The invention described herein was made in the performance of work under a NASA contract, and is subject to the provisions of Public Law 96-517 (35 USC 202) under which the inventors were granted a request to retain title.

BACKGROUND OF THE INVENTION

This invention relates to a vector excitation coder which efficiently compresses vectors of digital voice or audio for transmission or for storage, such as on magnetic tape or disc.

In recent developments of digital transmission of voice, it has become common practice to sample at 8 kHz and to group the samples into blocks of samples. Each block is commonlY referred to as a "vector" for a type of coding processing called Vector Excitation Coding (VXC). It is a powerful new technique for encoding analog speech or audio into a digital representation. Decoding and reconstruction of the original analog signal permits quality reproduction of the original signal.

Briefly, the prior art VXC is based on a new and general source-filter modeling technique in which the excitation signal for a speech production model is encoded at very low bit rates using vector quantization. Various architectures for speech coders which fall into this class have recently been shown to reproduce speech with very high perceptual quality.

In a generic VXC coder, a vocal-tract model is used in conjunction with a set of excitation vectors (codevectors) and a perceptually-based error criterion to synthesize natural-sounding speech. One example of such a coder is Code Excited Linear Prediction (CELP), which uses Gaussian random variables for the codevector components. M. R. Schroeder and B. S. Atal, "Code-Excited Linear Prediction (CELP): High-Quality Speech at Very Low Bit Rates," Proceedings Int'l. Conference on Acoustics, Speech, and Signal Processing, Tampa, March, 1985 and M. Copperi and D. Sereno, "CELP Coding for High-Quality Speech at 8 kbits/s," Proceedings Int'l. Conference on Acoustics, Speech, and Signal Processing, Tokyo, April, 1986. CELP achieves very high reconstructed speech quality, but at the cost of astronomic computational complexity (around 440 million multiply/add operations per second for real-time selection of the optimal codevector for each speech block).

In the present invention, VXC is employed with a sparse vector excitation to achieve the same high reconstructed speech quality as comparable schemes, but with significantly less computation. This new coder is denoted Pulse Vector Excitation Coding (PVXC). A variety of novel complexity reduction methods have been developed and combined, reducing optimal codevector selection computation to only 0.55 million multiply/adds per second, which is well within the capabilities of present data processors. This important characteristic makes the hardware implementation of a real-time PVXC coder possible using only one programmable digital signal processor chip, such as the AT&T DSP32. Implementation of similar speech coding algorithms using either programmable processors or high-speed, special-purpose devices is feasible but very impractical due to the large hardware complexity required.

Although PVXC of the present invention employs some characteristics of multipulse linear predictive coding (MPLPC) where excitation pulse amplitudes and locations are determined from the input speech, and some characteristics of CELP, where Gaussian excitation vectors are selected from a fixed codebook, there are several important differences between them. PVXC is distinguished from other excitation coders by the use of a precomputed and stored set of pulse-like (sparse) codevectors. This form of vocal-tract model excitation is used together with an efficient error minimization scheme in the Sparse Vector Fast Search (SVFS) and Enhanced SVFS complexity reduction methods. Finally, PVXC incorporates an excitation codebook which has been optimized to minimize the perceptually-weighted error between original and reconstructed speech waveforms. The optimization procedure is based on a centroid derivation. In addition, a complexity reduction scheme called Spectral Classification (SPC) is disclosed for excitation coders using a conventional codebook (fully-populated codevector components). There is currently a high demand for speech coding techniques which produce high-quality reconstructed speech at rates around 4.8 kb/s Such coders are needed to close the gap which exists between vocoders with an "electronic-accent" operating at 2.4 kb/s and newer, more sophisticated hybrid techniques which produce near toll-quality speech at 9.6 kb/s.

For real-time implementations, the promise of VXC has been thwarted somewhat by the associated high computational complexity. Recent research has shown that the dominant computation (excitation codebook search) can be reduced to around 40 M Flops without compromising speech quality However, this operation count is still too high to implement a practical real-time version using only a few current-generation DSP chips. The PVXC coder described herein produces natural-sounding speech at 4.8 kb/s and requires a total computation of only 1.2 M Flops.

OBJECTS AND SUMMARY OF THE INVENTION

The main object of this invention is to reduce the complexity of VXC speech coding techniques without sacrificing the perceptual quality of the reconstructed speech signal in the ways just mentioned.

A further object is to provide techniques for real-time vector excitation coding of speech at a rate below the midrate between 2.4 kb/s and 9.6 kb/s.

In the present invention, a fully-quantized PVXC produces natural-sounding speech at a rate well below the midrate between 2.4 kb/s and 9.6 kb/s. Near toll-quality reconstructed speech is achieved at these low rates primarily by exploiting codevector sparsity, by reformulating the search procedure in a mathematically less complex (but essentially equivalent) manner, and by precomputing intermediate quantities which are used for multiple input vectors in one speech frame. The coder incorporates a pulse excitation codebook which is designed using a novel perceptually-based clustering algorithm. Speech or audio samples are converted to digital form, partitioned into frames of L samples, and further partitioned into groups of k samples to form vectors with a dimension of k samples. The input vector $s_n$ is preprocessed to generate a perceptual weighted vector $z_n$, which is then subtracted from each member of a set of N weighted synthetic speech vectors $\{z_j\}$, $j \in \{1, \ldots, N\}$, where N is the number of excitation vectors in the codebook. The set $\{\hat{z}_j\}$ is generated by filtering pulse excitation (PE) codevectors $c_j$ with two time-varying, cascaded LPC synthesis filters $H_l(z)$ and $\tilde{H}_s(z)$. In synthesizing $\{\hat{z}_j\}$, each PE code-vector is scaled by a variable gain $G_j$ (determined by minimizing the mean-squared error between the weighted synthetic speech signal $\hat{z}_j$ and the weighted input speech vector $z_n$), filtered with cascaded long-term and short-term LPC synthesis filters, and then weighted by a perceptual weighting filter. The reason for perceptually weighting the input vector $z_n$ and the synthetic speech vector with the same weighting filter is to shape the spectuum of the error signal so that it is similar to the spectrum of $s_n$, thereby masking distortion which would otherwise be perceived by the human ear.

In the paragraph above, and in all the text that follows, a tilde (~) over a letter signifies the incorporation of a perceptual weighting factor, and a circumflex (^) signifies an estimate.

An exhaustive search over N vectors is performed for every input vector $s_n$ to determine the excitation vector $c_j$ which minimizes the squared Euclidean distortion $\|\tilde{e}_j\|^2$ between $z_n$ and $\hat{z}_j$. Once the optimal $c_j$ is selected, a codebook index which identifies it is transmitted to the decoder together with its associated gain. The parameters of $H_l(z)$ and $\tilde{H}_s(z)$ transmitted as side information once per input speech frame (after every (L/k)th $s_n$ vector).

A very useful linear systems representation of the synthesis filters and $\tilde{H}_s(z)$ and $H_l(z)$ is employed. Codebook search complexity is reduced by removing the effect of the deterministic component of speech (produced by synthesis filter memory from the previous vector—the zero input response) on the selection of the optimal codevector for the current input vector $s_n$. This is performed in the encoder only by first finding the zero-input response of the cascaded synthesis and weighting filters. The difference $z_n$ between a weighted input speech vector $r_n$ and this zero-input response is the input vector to the codebook search. The vector $r_n$ is produced by filtering $s_n$ with W(z), the perceptual weighting filter. With the effect of the deterministic component removed, the initial memory values in $\tilde{H}_s(z)$ and $H_l(z)$ can be set to zero when synthesizing $\{\hat{z}_j\}$ without affecting the choice of the optimal codevector. Once the optimal codevector is determined, filter memory from the previous encoded vector can be updated for use in encoding the subsequent vector. Not only does this filter representation allow further reduction in the computation necessary by efficiently expressing the speech synthesis operation as a matrix-vector product, but it also leads to a centroid calculation for use in optimal codebook design routines The novel features that are considered characteristic of this invention are set forth with particularity in the appended claims. The invention will best be understood from the following description when read in conjunction with the accompanying drawings.

DESCRIPTION OF PREFERRED EMBODIMENTS

Figure 1:
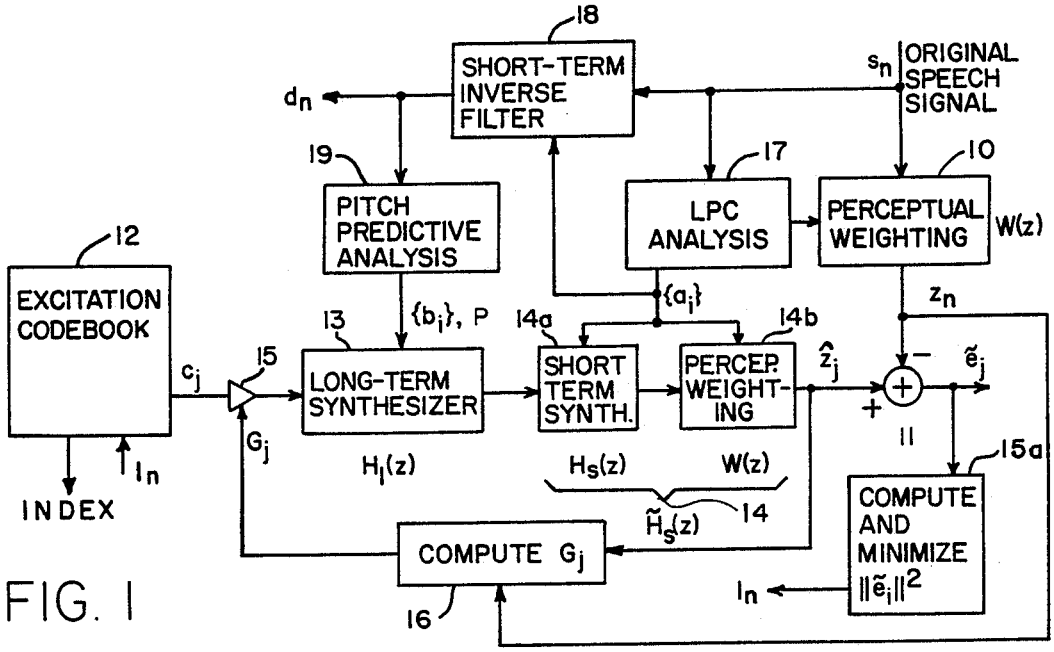
FIG. 1 is a block diagram of a VXC speech encoder embodying some of the improvements of this invention.

Before describing preferred embodiments of PVXC, the present invention, a VXC structure will first be described with reference to FIG. 1 to introduce some inventive concepts and show that they can be incorporated in any VXC-type system. The original speech signal $s_n$ is a vector with a dimension of k samples. This vector is weighted by a time-varying perceptual weighting filter 10 to produce $z_n$, which is then subtracted from each member of a set of N weighted synthetic speech vectors $\{\hat{z}_j\}$, $j \in \{1, \ldots, N\}$ in an adder 11. The set $\{\hat{z}_j\}$ is generated by filtering excitation codevectors $c_j$ (originating in a codebook 12) with cascaded long-term synthesizer (synthesis filter) filter 13 a short-term synthesizer (synthesis filter) 14*a* and a perceptual weighting filter 14*b*. Each codevector $c_j$ is scaled in an amplifier 15 by a gain factor $G_j$ (computed in a block 16) which is determined by minimizing the mean-squared error $\tilde{e}_j$ between $\hat{z}_j$ and the perceptually weighted speech vector $z_n$. In an exhaustive search VXC coder of this type, an excitation vector $c_j$ is selected in block 15*a* which minimizes the squared Euclidean error $\|\tilde{e}_j\|^2$ resulting from a comparison of vectors $z_n$ and every member of the set $\{\hat{z}_j\}$. An index $I_n$ having $\log_2 N$ bits which identifies the optimal $c_j$ is transmitted for each input vector $s_n$, along with $G_j$ and the synthesis filter parameters $\{a_i\}$, $\{b_i\}$, and P associated with the current input frame.

The transfer functions W(z), $H_l(z)$, and $H_s(z)$ of the time-varying recursive filters 10, 13 and 14*a,b* are given by $$W(z) = \frac{P(z)}{P(z/\gamma)} \tag{1a}$$

$$H_1(z) = \frac{1}{B(z)} \tag{1b}$$

$$H_s(z) = \frac{1}{P(z)} \tag{1c}$$

where $$P(z) = 1 + \sum_{i=1}^{p} a_i z^{-i}, B(z) = 1 + \sum_{i=-J}^{J} b_i z^{-P-i},$$

the $a_i$ are predictor coefficients obtained by a suitable LPC (linear predictive coding) analysis method of order p, the $b_i$ are predictor coefficients of a long-term LPC analysis of order $q=2J+1$, and the integer lag term P can roughly be described as the sample delay corresponding to one pitch period. The parameter $\gamma$ ($0 \leqq \gamma \leqq 1$) determines the amount of perceptual weighting applied to the error signal. The parameters $\{a_i\}$ are determined by a short-term LPC analysis 17 of a block of vectors, such as a frame of four vectors, each vector comprising 40 samples. The block of vectors is stored in an input buffer (not shown) during this analysis, and then processed to encode the vectors by selecting the best match between a preprocessed input vector $z_n$ and a synthetic vector $\hat{z}_j$, and transmitting only the index of the optimal excitation $c_j$. After computing a set of parameters $\{a_i\}$ (e.g., twelve of them), inverse filtering of the input vector $s_n$ is performed using a short-term inverse filter 18 to produce a residual vector $d_n$. The inverse filter has a transfer function equal to P(z). Pitch predictive analysis (long-term LPC analysis) 19 is then performed using the vector $d_n$, where $d_n$ represents a succession of residual vectors corresponding to every vector $s_n$ of the block or frame.

The perceptual weighting filter W(z) has been moved from its conventional location at the output of the error subtraction operation (adder 11) to both of its input branches. In this case, $s_n$ will be weighted once by W(z) (prior to the start of an excitation codebook search). In the second branch, the weighting function W(z) is incorporated into the short-term synthesizer channel now labeled short-term weighted synthesizer 14. This configuration is mathematically equivalent to the conventional design, but requires less computation. A desirable effect of moving W(z) is that its zeros exactly cancel the poles of the conventional short-term synthesizer 14a (LPC filter) 1/P(z), producing the pth order weighted synthesis filter.

$$H_s(z) = \frac{1}{P(z/\gamma)}$$

This arrangement requires a factor of 3 less computations per codevector than the conventional approach since only k(p+q) multiply/adds are required for filtering a codevector instead of k(3p+q) when W(z) weights the error signal directly. The structure of FIG. 1 is otherwise the same as conventional prior art VXC coders.

Computation can be further reduced by removing the effect of the memory in the filters 13 and 14 (having the transfer functions $H_l(z)$ and $\tilde{H}_s(z)$) on the selection of an optimal excitation for the current vector of input speech. This is accomplished using a very low-complexity technique to preprocess the weighted input speech vector once prior to the subsequent codebook search, as described in the last section. The result of this procedure is that the initial memory in these filters can be set to zero when synthesizing $\{\hat{z}_j\}$ without affecting the choice of the optimal codevector. Once the optimal cod-evector is determined, filter memory from the previous vector can be updated for encoding the subsequent vector. This approach also allows the speech synthesis operation to be efficiently expressed as a matrix-vector product, as will now be described.

For this method, called Sparse Vector Fast Search (SVFS), a new formulation of the LPC synthesis and weighting filters 13 and 14 is required. The following shows how a suitable algebraic manipulation and an appropriate but modest constraint on the Gaussian-like codevectors leads to an overall reduction in codebook search complexity by a factor of approximately ten. The complexity reduction factor can be increased by varying a parameter of the codebook construction process. The result is that the performance versus complexity characteristic exhibits a threshold effect that allows a substantial complexity saving before any perceptual degradation in quality is incurred. A side benefit of this technique is that memory storage for the excitation vectors is reduced by a factor of seven or more. Furthermore, codebook search computation is virtually independent of LPC filter order, making the use of high-order synthesis filters more attractive.

It was noted above that memory terms in the infinite impulse response filters $H_l(z)$ and $\tilde{H}_s(z)$ can be set to zero prior to synthesizing $\{\hat{z}_j\}$. This implies that the output of the filters 13 and 14 can be expressed as a convolution of two finite sequences of length k, scaled by a gain:

$$\hat{z}_j(m) = G_j(h(m) * c_j(m)), \tag{2}$$

$\hat{z}_j(m)$ is a sequence of weighted synthetic speech samples, h(m) is the impulse response of the combined short-term, long-term, and weighting filters, and $c_j(m)$ is a sequence of samples for the jth excitation vector.

A matrix representation of the convolution in equation (2) may be given as:

$$\hat{z}_j = G_j H c_j, \tag{3}$$

where H is a k by lower triangular matrix whose elements are from h(m):

$$H = \begin{vmatrix} h(0) & 0 & 0 & \dots & 0 \\ h(1) & h(0) & 0 & \dots & 0 \\ h(2) & h(1) & h(0) & \dots & 0 \\ . & . & . & \dots & 0 \\ . & . & . & \dots & 0 \\ h(k-1) & h(k-2) & h(k-3) & \dots & h(0) \end{vmatrix} \tag{4}$$

Now the weighted distortion from the jth codevector can be expressed simply as $$\|\tilde{e}_j\|^2 = \|z_n - \hat{z}_j\|^2 = \|z_n - Hc_j\|^2 \tag{5}$$

In general, the matrix computation to calculate $\hat{z}_j$ requires k(k+1)/2 operations of multiplication and addition versus k(p+q) for the conventional linear recursive filter realization For the chosen set of filter parameters (k=40, p+q=19), it would be slightly more expensive for an arbitrary excitation vector $c_j$ to compute $\|\tilde{e}_j\|$ using the matrix formulation since $(k+1)/2 > p+q$. However, if each $c_j$ is suitably chosen to have only $N_p$ pulses per vector (the other components are zero), then equation (5) can be computed very efficiently. Typically, $N_p/k$ is 0.1. More specifically, if the matrix-vector product $Hc_j$ is calculated using:

For $m=0$ *to* $k-1$
  If $c_j(m)=0$, then
    Next m
  otherwise
    For $i=m$ to $k-1$
      $\hat{z}_j(i) = \hat{z}_j(i) + c_j(m)\, h(k)$.

Then the average computation for $Hc_j$ is $N_p(k+1)/2$ multiply/adds, which is less than $k(p+q)$ if $N_p<37$ (for the k, p, and q given previously).

A very straightforward pulse codebook construction procedure exists which uses an initial set of vectors whose components are all nonzero to construct a set of sparse excitation codevectors. This procedure, called center-clipping, is described in a later section. The complexity reduction factor of this SVFS is adjusted by varying $N_p$, a parameter of the codebook design process.

zeroing of selected codevector components is consistent with results obtained in Multi-Pulse LPC (MPLPC) [B. S. Atal and J. R. Remde "A New Model of LPC Excitation for Producing Natural-Sounding Speech at Low Bit Rates" Proc. Int'l. Conf. on Acoustics, Speech, and Signal Processing, Paris, May 1982], since it has been shown that only about 8 pulses are required per pitch period (one pitch prriod is typically 5 ms for a female speaker) to synthesize natural-sounding speech. See S. Singhal and B. S. Atal, "Improving Performance of Multi-Pulse LPC Coders at Low Bit Rates," Proc. Int'l. Conf. on Acoustics, Speech and Signal Processing, San Diego, March 1984. Even more encouraging, simulation results of the present invention indicate that reconstructed speech quality does not start to deteriorate until the number of pulses per vector drops to 2 or 3 out of 40. Since, with the matrix formulation, computation decreases as the number of zero components increases, significant savings can be realized by using only 4 pulses per vector. In fact, when $N_p=4$ and $k=40$, filtering complexity reduction by a factor of ten is achieved.

Figure 1A:
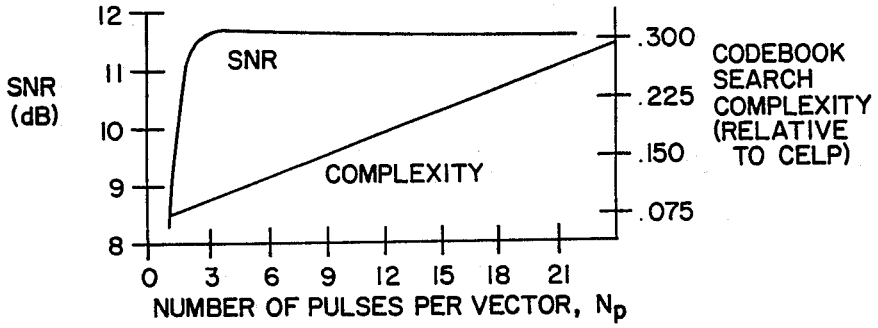
FIG. 1*a* is a graph of segmented SNR ($SNR_{seg}$) and overall codebook search complexity versus number of pulses per vector, $N_p$.

FIG. 1*a* shows plots of segmental SNR ($SNR_{seg}$) and overall codebook search complexity versus number of pulse per vector, $N_p$. It is noted that as $N_p$ decreases, $SNR_{seg}$ does not start to drop until $N_p$ reaches 3. In fact, informal listening tests show that the perceptual quality of the reconstructed speech signal actually improves slightly as $N_p$ is reduced from 40 to 4 and at the same time, the filtering computation complexity drops significantly.

It should also be noted that the required amount of codebook memory can be greatly reduced by storing only $N_p$ pulse amplitudes and their associated positions instead of k amplitudes (most of which are zero in this scheme). For example, memory storage reduction by a factor of 7.3 is achieved when $k=40$, $N_p=4$, and each codevector component is represented by a 16-bit word.

The second simplification (improvement), Spectral Classification, also reduces overall codebook search effort by a factor of approximately ten. It is based on the premise that it is possible to perform a precomputation of simple to moderate complexity using the input speech to eliminate a large percentage of excitation codevectors from consideration before an exhaustive search is performed.

Figure 4A:
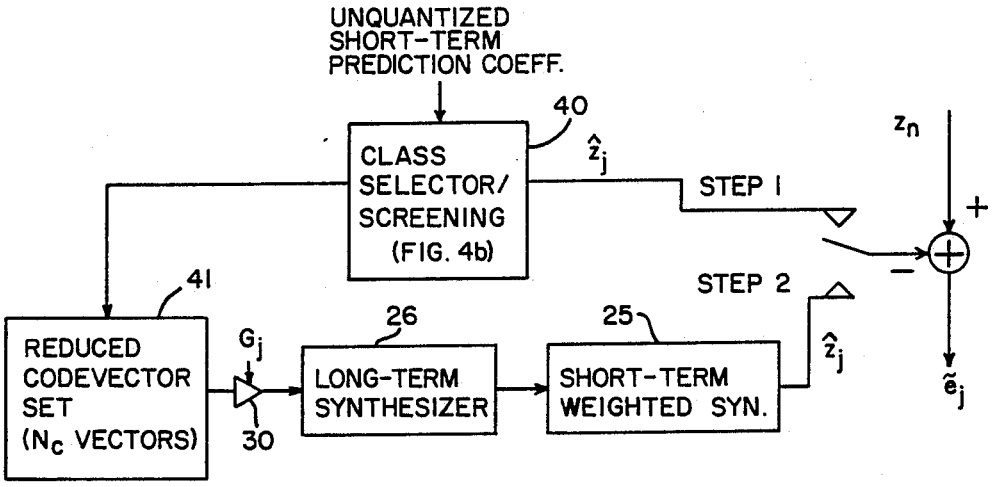
FIG. 4*a* is a functional block diagram which illustrates Spectral Classification, a two-step fast-search operation.

It has been shown by other researchers that for a given speech frame, the number of excitation vectors from a codebook of size 1024 which produce acceptably low distortion is small (approximately 5). The goal in this fast-search scheme, is to use a quick but approximate procedure to find a number $N_c$ of "good" candidate excitation vectors ($N_c<N$) for subsequent use in a reduced exhaustive search of $N_c$ codevectors. This two-step operation is presented in FIG. 4*a*.

Figure 4B:
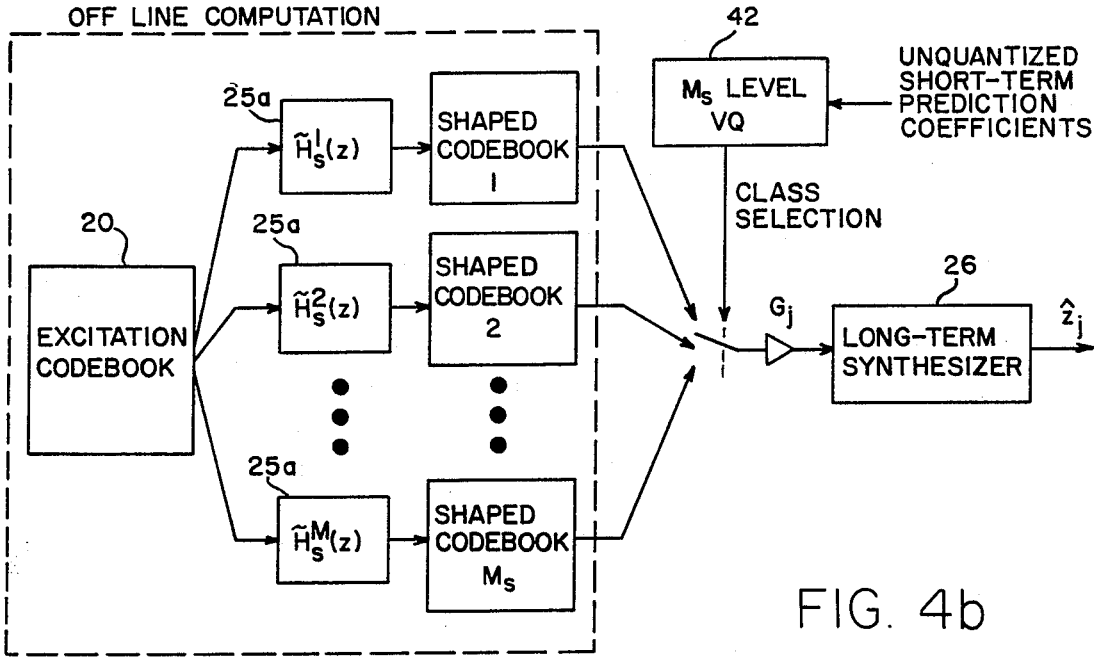
FIG. 4*b* is a block diagram which expands a functional block 40 in FIG. 4*a*.

In Step 1, the input vector $z_n$ is compared with $z_j$ to screen codevectors in block 40 and produce a set of $N_c$ candidate vectors to use in a reduced codevector search. Refer to FIG. 4*b* for an expanded view of block 40. The $N_c$ surviving codevectors are selected by making a rough classification of the gain-normalized spectral shape of the current speech frame into one of $M_s$ classes. One of $M_s$ corresponding codebooks (selected by the classification operation) is then used in a simplified speech synthesis procedure to generate $\hat{z}_j$. The excitation vectors $N_c$ producing the lowest distortions are selected in block 40 for use in Step 2, the reduced exhaustive search using the scalar 30, long-term synthesizer 26, and short-term weighted synthesizer 25 (filters 25*a* and 25*b* in cascade as before). The only thing different is a reduced codevector set, such as 30 codevectors reduced from 1024. This is where computational savings are achieved.

Spectral classification of the current speech frame in block 40 is performed by quantizing its short-term predictor coefficients using a vector quantizer 42 shown in FIG. 4*b* with $M_s$ spectral shape codevectors (typically $M_s=4$ to 8). This classification technique is very low in complexity (it comprises less than 0.2% of the total codebook search effort). The vector quantizer output (an index) selects one of $M_s$ corresponding codebooks to use in the speech synthesis procedure (one codebook for each spectral class). To construct each shaped cookbook, Gaussian-like codevectors from a pulse excitation codebook 20 are input to an LPC synthesis filter 25*a* representing the codebook's spectral class. The "shaped" codevectors are precomputed off-line and stored in the codebooks 1, 2 . . . $M_s$. By calculating the short-term filtered excitation off-line, this computational expense is saved in the encoder. Now the candidate excitation vectors from the original Gaussian-like codebook can be selected simply by filtering the shaped vectors from the selected class codebook with $H_f(z)$, and retaining only those $N_c$ vectors which produce the lowest weighted distortion. In Step 2 of Spectral Classification, a final exhaustive search over these $N_c$ vectors (to determine the optimal one) is conducted using quantized values of the predictor coefficients determined by LPC analysis of the current speech frame.

Figure 1B:
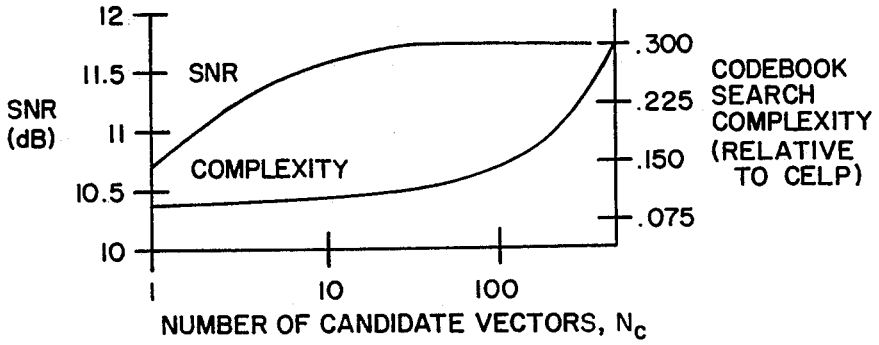
FIG. 1*b* is a graph of segmented SNR ($SNR_{seg}$) and overall codebook search complexity versus number of good candidate vectors, $N_c$, in the two-step fast-search operation of FIG. 4*a* and FIG. 4*b*.

Computer simulation results show that with $M_s=4$, $N_c$ can be as low as 30 with no loss in perceptual quality of the reconstructed speech, and when $N_c=10$, only a very slight degradation is noticeable. FIG. 1*b* summarizes the results of these simulations by showing how $SNR_{seg}$ and overall codebook search complexity change with $N_c$. Note that the drop in $SNR_{seg}$ as $N_c$ is reduced does not occur until after the knee of the complexity versus $N_c$ curve is passed.

The sparse-vector and spectral classification fast codebook search techniques for VXC have each been shown to reduce complexity by an order of magnitude without incurring a loss in subjective quality of the reconstructed speech signal. In the sparse-vector method, a matrix formulation of the LPC synthesis filters is presented which possesses distinct advantages over conventional all-pole recursive filter structures. In spectral classification, approximately 97% of the excitation codevectors are eliminated from the codebook search by using a crude identification of the spectral shape of the current frame. These two methods can be combined together or with other compatible fast-search schemes to achieve even greater reduction.

These techniques for reducing the complexity of Vector Excitation Coding (VXC) discussed above nn general will now be described with reference to a particular embodiment called PVXC utilizing a pulse excitation (PE) codebook in which codevectors have been designed as just described with zeroing of selected codevector components to leave, for example, only four pulses, i.e., nonzero samples, for a vector of 40 samples. It is this pulse characteristic of PE codevectors that suggest the name "pulse vector excitation coder" referred to as PVXC.

PVXC is a hybrid speech coder which combines an analysis-by-synthesis approach with conventional waveform compression techniques. The basic structure of PVXC is presented in FIG. 2. The encoder consists of an LPC-based speech production model and an error weighting function W(z). The production model contains two time-varying, cascaded LPC synthesis filters $H_s(z)$ and $H_l(z)$ describing the vocal tract, a codebook 20 of N pulse-like excitation vectors $c_j$, and a gain term $G_j$. As before, $H_s(z)$ describes the spectral envelope of the original speech signal $s_n$, and $H_l(z)$ is a long-term synthesizer which reproduces the spectral fine structure (pitch). The transfer functions of $H_s(z)$ and $H_l(z)$ are given by $H_s(z)=1/P_s(z)$ and $H_l(z)=1/P_l(z)$ where $$P_s(z) = 1 + \sum_{i=1}^{p} a_i z^{-i}$$

and $$P_l(z) = 1 + \sum_{i=1}^{J} b_i z^{-P-i}.$$

Here, $a_i$ and $b_i$ are the quantized short and long-term predictor coefficients, respectively, P is the "pitch" term derived from the short-term LPC residual signal ($20 \leqq P \leqq 147$), and p and q ($=2J+1$) are the short and long-term predictor orders, respectively. Tenth order short-term LPC analysis is performed on frames of length $L=160$ samples (20 ms for an 8 kHz sampling rate). $P_l(z)$ contains a 3-tap predictor ($J=1$) which is updated once per frame. The weighting filter has a transfer function $W(z)=P_s(z)/P_s(z/\gamma)$, where $P_s(z)$ contains the unquantized predictor parameters and $0 \leqq \gamma \leqq 1$. The purpose of the perceptual weighting filter W(z) is the same as before.

Figure 2:
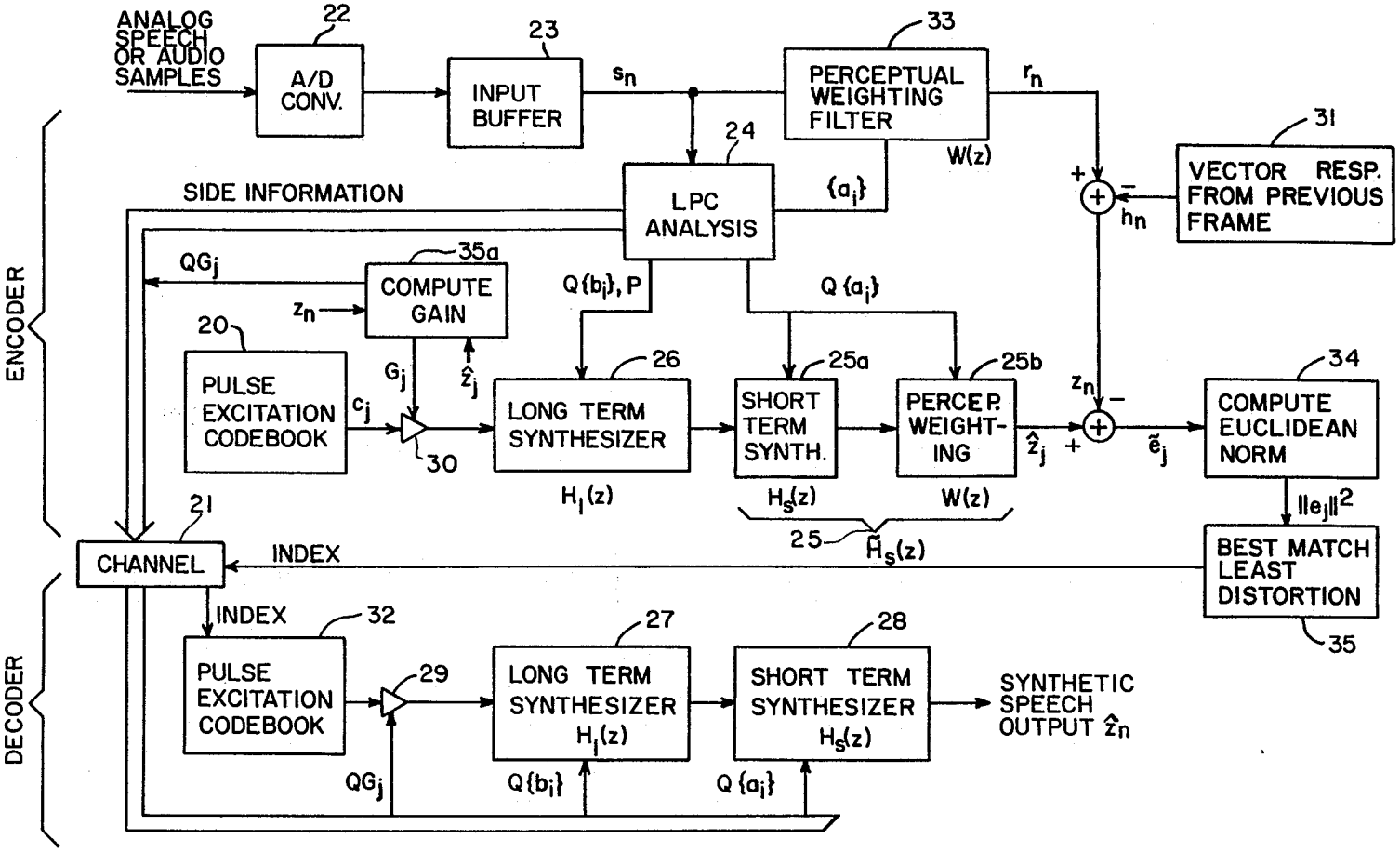
FIG. 2 is a block diagram of a PVXC speech encoder embodying the present invention.

Referring to FIG. 2, the basic structure of a PVXC system (encoder and decoder) is shown with the encoder (transmitter) in the upper part connected to a decoder (receiver) by a channel 21 over which a pulse excitation (PE) codevector index and gain is transmitted for each input vector $s_n$ after encoding in accordance with this invention. Side information, consisting of the parameters $Q\{a_i\}$, $Q\{b_i\}$, $QG_j$ and P, are transmitted to the decoder once per frame (every L input samples). The original speech input samples s, converted to digital form in an analog-to-digital converter 22, are partitioned into a frame of L/k vectors, with each vector having a group of k successive samples. More than one frame is stored in a buffer 23, which thus stores more than 160 samples at a time, such as 320 samples.

For each frame, an analysis section 24 performs short-term LPC analysis and long-term LPC analysis to determine the parameters $\{a_i\}$, $\{b_i\}$ and P from the original speech contained in the frame. These parameters are used in a short-term synthesizer 25*a* comprised of a digital filter specified by the parameters $\{a_i\}$, and a perceptual weighting filter 25*b*, and in a long-term synthesizer 26 comprised of a digital filter specified by four parameters $\{b_i\}$ and P. These parameters are coded using quantizing tables and only their indices $Q\{a_i\}$ and $Q\{b_i\}$ are sent as side information to the decoder which uses them to specify the filters of long-term and short-term synthesizers 27 and 28, respectively, in reconstructing the speech. The channel 21 includes at its encoder output a multiplexer to first transmit the side information, and then the codevector indices and gains, i. e., the encoded vectors of a frame, together with a quantized gain factor $QG_j$ computed for each vector. The channel then includes at its output a demultiplexer to send the side information to the long-term and short-term synthesizers in the decoder. The quantized gain factor $QG_j$ of each vector is sent to a scaler 29 (corresponding to a scaler 30 in the encoder) with the decoded codevector.

After the LPC analysis has been competed for a frame, the encoder is ready to select an appropriate pulse excitation from the codebook 20 for each of the original speech vectors in the buffer 23. The first step is to retrieve one input vector from the buffer 23 and filter it with the perceptual weighting filter 33. The next step is to find the zero-input response of the cascaded encoder synthesis filters 25*a,b*, and the long-term synthesizer 26. The computation required is indicated by a block 31 which is labeled "vector response from previous frame". Knowing the transfer functions of the long-term, short-term and weighting filters, and knowing the memory in these filters, a zero-input response $h_n$ is computed once for each vector and subtracted from the corresponding weighted input vector $r_n$ to produce a residual vector $z_n$. This effectively removes the residual effects (ringing) caused by filter memory from past inputs. With the effect of the zero-input response removed, the initial memory values in $H_l(z)$ and $\bar{H}_s(z)$ can be set to zero when synthesizing the set of vectors $\{\hat{z}_j\}$ without effecting the choice of the optimal codevector. The pulse excitation codebook 32 in the decoder identically corresponds to the encoder pulse excitation codebook 20. The transmitted indices can then be used to address the decoder PE codebook 32.

The next step in performing a codebook search for each vector within one frame is to take all N PE codevectors in the codebook, and using them as pulse excitation vectors $c_j$, pass them one at a time through the scaler 30, long-term synthesizer 26 and short-term weighted synthesizer 25 in cascade, and calculate the vector $\hat{z}_j$ that results for each of the PE codevectors. This is done N times for each new input vector $z_n$. Next, the perceptually weighted vector $z_n$ is subtracted from the vector $\hat{z}_j$ to produce an error $\tilde{e}_j$. This is done for each of the N PE codevectors of the codebook 20, and the set of errors $\{\tilde{e}_j\}$ is stored in a block 34 which computes the Euclidean norm. The set $\{\tilde{e}_j\}$ is stored in the same indexed order as the PE codevectors $\{c_j\}$ so that when a search is made in a block 35 for the best-match i.e., least distortion, the index of that error $\tilde{e}_j$ which produces the least distortion index can be transmitted to the decoder via the channel 21.

In the receiver, the side information $Q\{b_i\}$ and $Q\{a_i\}$ received for each frame of vectors is used to specify the transfer functions $H_l(z)$ and $H_s(z)$ of the long-term and short-term synthesizers 27 and 28 to match the corresponding synthesizers in the transmitter but without perceptual weighting. The gain factor $QG_j$, which is determined to be optimum for each $c_j$ in the search for the least error index, is transmitted with the index, as noted above. Thus, while $QG_j$ is in essence side information used to control the scaling unit 29 to correspond to the gain of the scaling unit 30 in the transmitter at the time the least error was found, it is not transmitted in a block with the parameters $Q\{a_i\}$ and $Q\{b_i\}$.

The index of a PE codevector $c_j$ is received together with its associated gain factor to extract the identical PE codevector $c_j$ at the decoder for excitation of the synthesizers 27 and 28. In that way an output vector $\hat{s}_n$ is synthesized which closely matches the vector $\hat{z}_j$ that best matched $z_n$ (derived from the input vector $s_n$). The perceptual weighting used in the transmitter, but not the reciever, shapes the spectrum of the error $\tilde{e}_j$ so that it is similar to $s_n$. An important feature of this invention is to apply the perceptual weighting function to the PE codevector $c_j$ and to the speech vector $s_n$ instead of to the error $\tilde{e}_j$. By applying the perceptual weighting factor to both of the vectors at the input of the summer used to form the error $\tilde{e}_j$ instead of at the conventional location to the error signal directly, a number of advantages are achieved over the prior art. First, the error computation given in Eq. 5 can be expressed in terms of a matrix-vector product. Second, the zeros of the weighting filter cancel the poles of the conventional short-term synthesizer 25a (LPC filter), producing the $p^{th}$ order weighted synthesis filter $\tilde{H}_s(z)$ as noted hereinbefore with reference to FIG. 1 and Eq. 1.

That advantage, coupled with the sparse vector coding (i.e., zeroing of selected samples of a code-vector), greatly facilitates implementing the code-book search. An exhaustive search is performed for every input vector $s_n$ to determine the excitation vector $c_j$ which minimizes the Euclidean distortion $\|\tilde{e}_j\|^2$ between $z_n$ and $\hat{z}_j$ as noted hereinbefore. It is therefore important to minimize the number of operations necessarry in the best-match search of each excitation vector $c_j$. Once the optimal (best match) $c_j$ is found, the codebook index of the optimal $c_j$ is transmitted with the associated quantized gain $QG_j$.

Since the search for the optimal $c_j$ requires the most computation, the Sparse Vector Fast Search SVFS) technique, discussed hereinbefore, has been developed as the basic PE codevector search for the optimal $c_j$ in PVXC speech or audio coders. An enhanced SVFS method combines the matrix formulation of the synthesis filters given above and a pulse excitation model with ideas proposed by I. M. Trancoso and B. S. Atal, "Efficient Procedures for Finding the Optimum Innovation in Stochastic Coders," Proceedings Int'l Conference on Acoustics, Speech, and Signal Processing, Tokyo, April 1986, to achieve substantially less computation per codebook search than either method achieves separately. Enhanced SVFS requires only 0.55 million multiply/adds per second in a real-time implementation with a codebook size 256 and vector dimension 40.

In Trancoso and Atal, it is shown that the weighted error minimization procedure associated with the selection of an optimal codevector can be equivalently expressed as a maximization of the following ratio:

$$\frac{(z^T H c_j)^2}{\|H c_j\|^2} \approx \frac{(v^T c_j)^2}{R_{hh}(0)R^j_{cc}(0) + 2\sum_{i=1}^{k-1} R_{hh}(i)R^j_{cc}(i)}, \quad (6)$$

where $R_{hh}(i)$ and $R_{cc}^j(i)$ are outocorrelations of the impulse response h(m) and the jth codevector $c_j$, respectively. As noted by Trancoso and Atal, $G_j$ no longer appears explicitly in Eq. (6): however, the gain is optimized automatically for each $c_j$ in the search procedure. Once an optimal index is selected, the gain can be calculated from $z_n$ and $\hat{z}_j$ in block 35a and quantized for transmission with the index in block 21.

In the enhanced SVFS method, the fact is exploited that high reconstructed speech quality is maintained when the codevectors are sparse. In this case, $c_j$ and $R_{cc}^j(i)$ both contain many zero terms, leading to a significantly simplified method for calculating the numerator and denominator in Eq. (6). Note that the $R_{cc}^j(i)$ can be precomputed and stored in ROM memory together with the excitation codevectors $c_j$. Furthermore, the squared Euclidean norms $\|H c_j\|^2$ only need to be computed once per frame and stored in a RAM memory of size N words. Similarly, the vector $v^T = z^T H$ only needs to be computed once per input vector.

Figure 3:
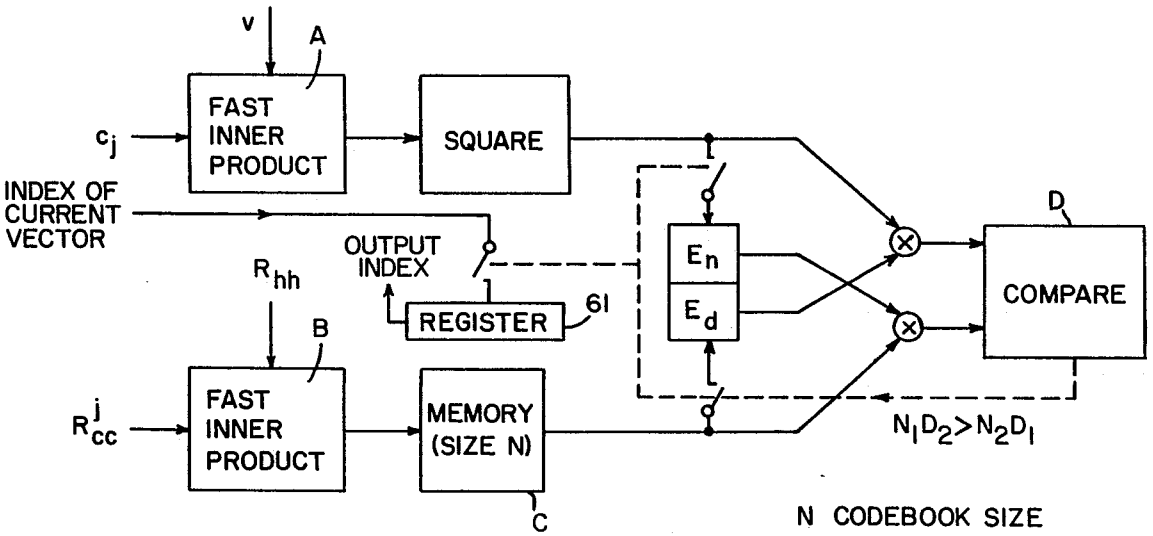
FIG. 3 illustrates in a functional block diagram the codebook search operation for the system of FIG. 2 suitable for implementation using programmable signal processors.

The codebook search operation for the PVXC of FIG. 2 suitable for implementation using programmable digital signal processor (DSP) chips, such as the AT&T DSP32, is depicted in FIG. 3. Here, the numerator term in Eq. (6) is calculated in block A by a fast inner product (which exploits the sparseness of $c_j$). A similar fast inner product is used in the precomputation of the N denominator terms in block B. The denominator on the right-hand side of Eq. (6) is computed once per frame and stored in a memory c. The numerator, on the other hand, is computed for every excitation codevector in the codebook. A codebook search is performed by finding the $c_j$ which maximizes the ratio in Eq. (6). At any point in time, registers $E_n$ and $E_d$ contain the respective numerator and denominator ratio terms corresponding to the best codevector found in the search so far. Products between the contents of the register $E_n$ and $E_d$, and the numerator and denominator terms of the current codevector are generated and compared. Assuming the numerator $N_l$ and denominator $D_l$ are stored in the respective registers from the previous excitation vector $c_{j-1}$ trial, and the numerator $N_2$ and denominator $D_2$ are now present from the current excitation vector $c_j$ trial, the comparison in block 60 is to determine if $N_2/D_2$ is less than $N_l/D_l$. Upon cross multiplying the numerators $N_l$ and $N_2$ with the denominators $D_l$ and $D_2$, we have $N_lD_2$ and $N_2D_l$. The comparison is then to determine if $N_lD_2 > N_2D_l$. If so, the ratio $N_l/D_l$ is retained in the registers $E_N$ and $E_d$. If not, they are updated with $N_2$ and $D_2$. This is indicated by a dashed control line labeled $N_lD_2 > N_2D_l$. Each time the control updates the registers, it updates a register E with the index of the current excitation codevector $c_j$. When all excitation vectors $c_j$ have been tested, the index to be transmitted is present in the register E. That register is cleared at the start of the search for the next vector $z_n$.

This cross-multiplication scheme avoids the division operation in Eq. (6), making it more suitable for implementation using DSP chips. Also, seven times less memory is required since only a few, such as four pulses (amplitudes and positions) out of 40 (in the example given with reference to FIG. 2) must be stored per codevector compared to 40 amplitudes for the case of a conventional Gaussian codevector.

The data compaction scheme for storing the PE codebook and the PE autocorrelation codebook will now be described. One method for storing the codebook is to allocate k memory locations for each codevector, where k is the vector dimension. Then the total memory required to store a codebook of size N is kN locations. An alternative approach which is appropriate for storing sparse codevectors is to encode and store only those $N_p$ samples in each codevector which are nonzero. The zero samples need not be stored as they would have been if the first approach above were used. In the new technique, each nonzero sample is encoded as an ordered pair of numbers (a,l). The first number a corresponds to the amplitude of the sample in the codevector, and the second number l identifies its location within the vector. The location number is typically an integer between 1 and k, inclusive.

If it is assumed that each location l can be stored using only one-half of a single memory location (as is reasonable since l is typically only a six-bit word), then the total memory required to store a PE codebook is $(N_p+N_{p/2})\,N=1.5\,N_pN$ locations. For a PE codebook with dimension 40, and with $N_p=4$, a savings factor of 7 is achieved compared to the first approach just given above. Since the PE autocorrelation codebook is also sparse, the same technique can also be used to efficiently store it.

A preferred embodiment of the present invention will now be described with a reference to FIG. 5 which illustrates an architecture implemented with a programmable signal processor, such as the AT&T DSP32. The first stage 51 of the encoder (transmitter) is a low-pass filter, and the second stage 52 is a sample-and-hold type of analog-to-digital converter. Both of these stages are implemented with commercially available integrated circuits, but the second stage is controlled by a programmable digital signal processor (DSP).

The third stage 53 is a buffer for storing a block of 160 samples partitioned into vectors of dimension k=40. This buffer is implemented in the memory space of the DSP, which is not shown in the block diagram; only the functions carried out by the DSP are shown. The buffer thus stores a frame of four vectors of dimension 40. In practice, two buffers are preferably provided so that one may receive and store samples while the other is used in coding the vectors in a frame. Such double buffering is conventional in real-time digital signal processing.

The first step in vector encoding after the buffer is filled with one frame of vectors is to perform short-term linear predictive coding (LPC) analysis on the signals in block 54 to extract from a frame of vectors a set of ten parameters $\{a_i\}$. These parameters are used to define a filter in block 55 for inverse predictive filtering. The transfer function of this inverse predictive filter is equal to P(z) of Eq. 1. These blocks 54, 55, and 56 correspond to the analysis section 24 of FIG. 2. Together they provide all the preliminary analysis necessary for each successive frame of the input signal $s_n$ to extract all of the parameters $\{a_i\}$, $\{b_i\}$ and P.

The inverse predictive filtering process generates a signal r, which is the residual remaining after removing redundancy from the input signal s. Long-term LPC analysis is then performed on the residual signal r in block 56 to extract a set of four parameters $\{b_i\}$ and P. The value P represents a quasi-pitch term similar to the one pitch period of speech which ranges from 20 to 147.

A perceptual weighting filter 57 receives the input signal sn This filter also receives the set of parameters $\{a_i\}$ to specify its transfer function W(z) in Eq. 1.

The parameters $\{a_i\}$, $\{b_i\}$ and P are quantized using a table, and coded using the index of the quantized parameters. These indices are transmitted as side information through a multiplexer 67 to a channel 68 that connects the encoder to a receiver in accordance with the architecture described with reference to FIG. 2.

After the LPC analysis has been completed for a frame of four vectors, 40 samples per vector for a total of 160 samples, the encoder is ready to select an appropriate excitation for each of the four speech vectors in the analyzed frame. The first step in the selection process is to find the impulse response h(n) of the cascaded short-term and long-term synthesizers and the weighting filter. That is accomplished in a block 59 labeled "filter characterization," which is equivalent to defining the filter characteristics (transfer functions) for the filters 25 and 26 shown in FIG. 2. The impulse response h(n) corresponding to the cascaded filters is basically a linear systems characterization of these filters.

Keeping in mind that what has been described thus far is in preparation for doing a codebook search for four successive vectors, one at a time within one frame, the next preparatory step is to compute the Euclidean norm of synthetic vectors in block 60. Basically, the quantities being calculated are the energy of the synthetic vectors that are produced by filtering the PE codevectors from a pulse excitation codebook 63 through the cascaded synthesizers shown in FIG. 2. This is done for all 256 codevectors one time per frame of input speech vectors. These quantities, $\|Hc_j\|^2$, are used for encoding all four speech vectors within one frame. The computation for those quantities is given by the following equation:

$$\|z_j\|^2 = \|Hc_j\|^2 = R_{hh}(0)R^j_{cc} + 2\sum_{n=1}^{k-1} R_{hh}(n)R^j_{cc}(n) \tag{7}$$

where H is a matrix which contains elements of the impulse response, $c_j$ is one excitation vector, and $$R_{hh}(i) = \sum_{n=0}^{k-1} h(n)h(n+i) \tag{8b}$$

$$R^j_{cc}(i) = \sum_{n=0}^{k-1} c_j(n)c_j(n+i). \tag{8b}$$

So, the quantities $\|Hc_j\|^2$ are computed using the values $R_{cc}^j(i)$, the autocorrelation of $c_j$. The squared Euclidean norm $\|Hc_j\|^2$ at this point is simply the energy of $\hat{z}_j$ shown in FIG. 2. Thus, the precomputation in block 60 is effectively to take every excitation vector from the pulse excitation codebook 63, scale it with a gain factor of 1, filter it through the long-term synthesizer, the short-term synthesizer, and the weighting filter, calculate the synthetic speech vector $\hat{z}_j$, and then calculate the energy of that vector. This computation is done before doing a pulse excitation codebook search in accordance with Eq. (7).

From this equation it is seen that the energy of each synthetic vector is a sum of products involving the autocorrelation of impulse response $R_{hh}$ and the autocorrelation of the pulse excitation vector for the particular synthetic vector $R_{cc}^j$. The energy is computed for each $c_j$. The parameter i in the equations for $R_{cc}^j$ and $R_{hh}$ indicates the length of shift for each product in a sequence in forming the sum of products. For example, if i=0, there is no shift, and summing the products is equivalent to squaring and accumulating all of the terms within two sequences. If there is a sequence of length 5, i.e., if there are five samples in the sequence, the autocorrelation for i=0 is found by producing another copy of the sequence of samples, multiplying the two sequences of samples, and summing the products. That is indicated in the equation by the summation of products. For i=1, one of the sequences is shifted by one sample, and then the corresponding terms are multiplied and added. The number of samples in a vector is k=40, so i ranges from 0 up to 39 in integers. Consequently, $\| Hc_j \|^2$ is a sum of products between two autocorrelations: one autocorrelation is the autocorrelation of the impulse response, $R_{hh}$, and the other is the autocorrelation of the pulse excitation vector $R_{cc}^j$. The j symbol indicates that it is the $j^{th}$ pulse excitation vector. It is more efficient to synthesize vectors at this point and calculate their energies, which are stored in the block 60, than to perform the calculation in the more straightforward way discussed above with reference to FIG. 2. Once these energies are computed for 256 vectors in the codebook 61, the pulse excitation codebook search represented by block 62 may commence, using the predetermined and permanent pulse excitation codebook 63, from which the pulse excitation autocorrelation codebook is derived. In other words, after precomputing (designing) and storing the permanent pulse excitation vectors for the codebook 63, a corresponding set of autocorrelation vectors $R_{cc}$ are computed and stored in the block 61 for encoding in real time.

In order to derive the input vector $z_n$ to the excitation codebook search, the speech input vector $s_n$ from the buffer 53 is first passed through the perceptual weighting filter 57, and the weighted vector is passed through a block 64 the function of which is to remove the effect of the filter memory in the encoder synthesis and weighting filters. i.e., to remove the zero-input response (zIR) in order to present a vector $z_n$ to the codebook search in block 62.

Before describing how the codebook search is performed, reference should be made to FIG. 3. The bottom part of that figure shows how the precomputation of the energy of the synthetic vector is carried out. Note that there is a correlation between Eq. (8) and block B in the bottom part of this figure. In accordance with Eq. (8), the autocorrelation of the pulse vector and the autocorrelation of the impulse response are used to compute $\| Hc_j \|^2$, and the results are stored in a memory c of size N, where N is the codebook size. For each pulse excitation vector, there is one energy value stored.

As just noted above with reference to FIG. 5, these quantities $R_{cc}^j$ can be computed once and stored in memory as well as the pulse excitation vectors of the codebook in block 63 of FIG. 5. That is, these quantities $R_{cc}^j$ are a function of whatever pulse excitation codebook is designed, so they do not need to be computed on-line. It is thus clear that in this embodiment of the invention, there are actually two codebooks stored in a ROM. One is a pulse excitation codebook in block 63, and the second is the autocorrelation of those codes in block 61. But the impulse response is different for every frame. Consequently, it is necessary to compute Eq. (8) to find N terms and store them in memory c for the duration of the frame.

In selecting an optimal excitation vector, Eq. (6) is used. That is essentially equivalent to the straightforward approach described with reference to FIG. 2, which is to take each excitation, filter it, compute a weighted error vector and its Euclidean norm, and find an optimal excitation. By using Eq. (6), it is possible to calculate for each PE codevector the denominator of Eq. (6). Each $\| Hc_j \|^2$ term is then simply called out of memory as it is needed once it has been computed. It is then necessary to compute on line the numerator of Eq. (6), which is a function of the input speech, because there is a vector z in the equation. The vector vT, where T denotes a vector transpose operation, at the output of a correlation generator block 65 is equvalent to $z^T H$. And v is calculated as just a sum of products between the impulse response hn of the filter and the input vector $z_n$. So for the $v^T$, we substitute the following:

$$v(i) = \sum_{n=0}^{k-1} h(n)z(n + L) \tag{9}$$

Consequently, Eq. (6) can be used to select an optimal excitation by calculating the numerator and precalculating the denominator to find the quotient, and then finding which pulse excitation vector maximizes this quotient. The denominator can be calculated once and stored, so all that is necessary is to pre compute v, perform a fast inner product between c and v, and then square the result. Instead of doing a division every time as Eq. (6) would require, an equivalent way is to do a cross product as shown in FIG. 3 and described above.

Figure 5:
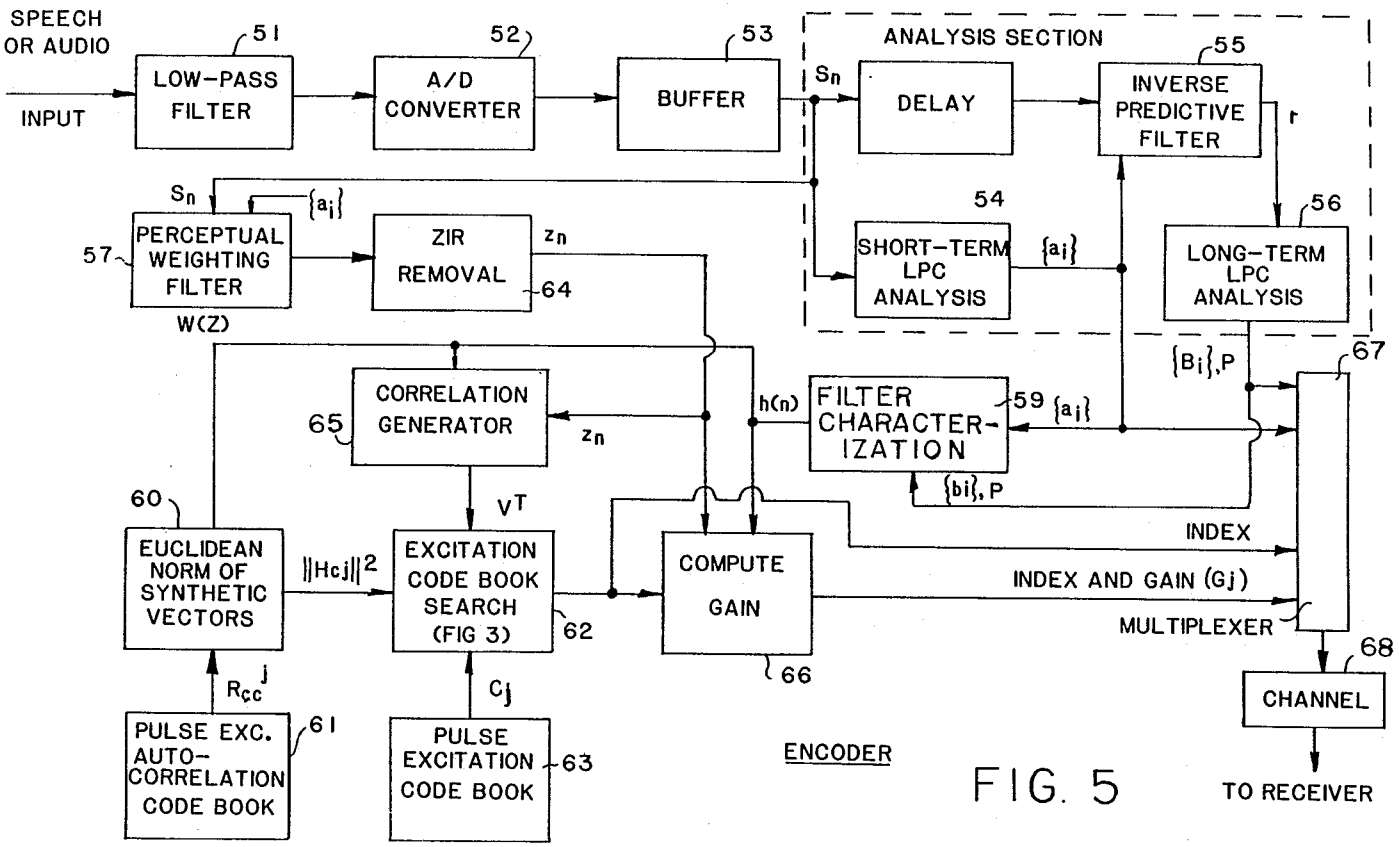
FIG. 5 is a schematic diagram disclosing a preferred embodiment of the architecture for the PVXC speech encoder of FIG. 2.

This block diagram of FIG. 5 is actually more detailed than shown and described with reference to FIG. 2. The next problem is how to keep track of the index and keep track of which of these pulse excitation vectors is the best. That is indicated in FIG. 5.

In order to perform the excitation codebook search, what is needed is the pulse excitation code $c_j$ from the codebook 63 itself, and the v vector from block 64. Also needed are the energies of the synthetic vectors precomputed once every frame coming from block 60. Now assuming an appropriate excitation index has been calculated for an input vector $s_n$, the last step in the process of encoding every excitation is to select a gain factor $G_j$ in block 66. A gain factor $G_j$ has to be selected for every excitation. The excitation codebook search takes into account that this gain can vary. Therefore in the optimization procedure for minimizing the perceptually weighted error, a gain factor is picked which minimizes the distortion. An alternative would be to compute a fixed gain prior to the codebook search, and then use that gain for every excitation vector. A better way is to compute an optimal gain factor $G_j$ for each codevector in the codebook search and then transmit an index of the quantized gain associated with the best codevector $c_j$. That process is automatically incorporated into Eq. (6). In other words, by maximizing the ratio of Eq. (6), the gain is automatically optimized as well. Thus, what the encoder does in the process of doing the codebook search is to automatically optimize the gain without explicitly calculating it.

The very last step after the index of an optimal excitation codevector is selected is to calculate the optimal gain used in the selection, which is to say compute it from collected data in order to transmit its index from a gain quantizing table. It is a function of z, as shown in the following equation:

$$G_j = \frac{\sum_{n=0}^{k-1} \hat{z}_j(n)z(n)}{\sum_{n=0}^{k-1} [\hat{z}_j(n)]^2} \tag{10}$$

The gain computation and quantization is carried out in block 66.

From Eq. (10) it is seen that the gain is a function of z(n) and the current synthetic speech vector $\hat{z}_j(n)$. Consequently, it is possible to derive the gain $G_j$ by calculating the crosscorrelation between the synthetic speech vector $\hat{z}j$ and the input vector $z_n$ This is done after an optimal excitation has been selected. The signal $\hat{z}_j(n)$ is computed using the impulse response of the encoder synthesis and weighting filters, and the optimal excitation vector $c_j$. Eq. (10) states that the process is to synthesize a synthetic speech vector using an optimal excitation, calculate the crosscorrelation between original speech and that synthetic vector, and then divide it by the energy in the synthetic speech vector that is the sum of the squares of the synthetic vector $\hat{z}_j(n)^2$. That is the last step in the encoder.

For each frame, the encoder provides (1) a collection of long-term filter parameters $\{b_i\}$and P, (2) short-term filter parameters $\{a_i\}$, (3) a set of pulse vector excitation indices, each one of length $\log_2 N$ bits, and (4) a set of gain factors, with one gain for each of the pulse excitation vector indices. All of this is multiplexed and transmitted over the channel 68. The decoder simply demultiplexes the bit stream it receives.

The decoder shown in FIG. 2 receives the indices, gain factors, and the parameters $\{a_i\}$, $\{b_i\}$, and P for the speech production synthesizer. Then it simply has to take an index, do a table lookup to get the excitation vector, scale that by the gain factor, pass that through the speech synthesizer filter and then, finally, perform D/A conversion and low-pass filtering to produce the reconstructed speech.

A conventional Gaussian codebook of size 256 cannot be used in VXC without incurring a substantial drop in reconstructed signal quality. At the same time, no algorithms have previously been shown to exist for designing an optimal codebook for VXC-type coders. Designed excitation codebooks are optimal in the sense that the average perceptually-weighted error between the original and synthetic speech signals is minimized. Although convergence of the codebook design procedure cannot be strictly guaranteed, in practice large improvement is gained in the first few iteration steps, and thereafter the algorithm can be halted when a suitable convergence criterion is satisfied. Computer simulations show that both the segmental SNR and perceptual quality of the reconstructed speech increase when an optimized codebook is used (compared to a Gaussian codebook of the same size). An algorithm for designing an optimal codebook will now be described.

Figure 6:
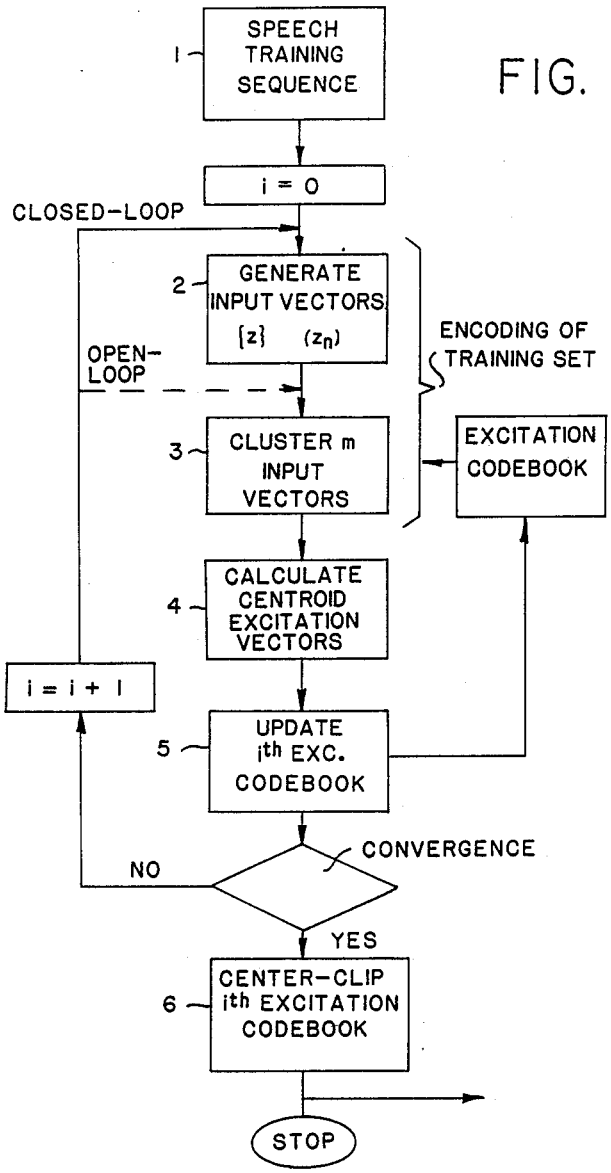
FIG. 6 is a flow chart for the preparation and use of an excitation codebook in the PVXC speech encoder of FIG. 2.

The flow chart of FIG. 6 describes how the pulse excitation codebook is designed. The procedure starts in block 1 with a speech training sequence using a very long segment of speech, typically eight minutes. The problem is to analyze that training segment and prepare a pulse excitation codebook.

The training sequence includes a broad class of speakers (male, female, young, old). The more general this training sequence, the more robust the codebook will be in an actual application. Consequently, this training sequence should be long enough to include all manner of speech and accents. The training sequence is an iterative process. It starts with one excitation codebook. For example, it can start with a codebook having Gaussian samples. The technique is to iteratively improve on it, and when the algorithm has converged, the iterative process is terminated. The permanent pulse excitation codebook is then extracted from the output of this iterative algorithm.

The iterative algorithm produces an excitation codebook with fully-populated codevectors. The last step center clips those codevectors to get the final pulse excitation codebook. Center clipping means to eliminate small samples, i.e., to reduce all the small amplitude samples to zero, and keep only the largest, until only the $N_p$ largest samples remain in each vector. In summary, having a sequence of numbers to construct a pulse excitation codevector, the final step in the iterative process to construct a pulse excitation codebook is to retain out of k samples the $N_p$ samples of largest amplitude.

Design of the PE codebook 63 shown in FIG. 5 will now be described in more detail with reference to FIG. 6. The first step in the iterative technique is to basically encode the training set. Prior to that there has been made available (in block 1) a very long segment of original speech. That long segment of speech is analyzed in block 2 to produce m input vectors $z_n$ from the training sequence Next the coder of FIG. 5 is used to encode each of these m input vectors. Once the sequence of vectors $z_n$ are available, a clustering operation is performed in block 3. That is done by collecting all of the input vectors $z_n$ which are associated with one particular codevector.

Assuming completion of encoding this whole training sequence, and assuming the first excitation vector is picked as the optimal one for 10 training set vectors, and the second one is selected 20 times, for the case of the first vector, those 10 input vectors are grouped together and associated with the first excitation vector $c_l$. For the next excitation, all the input vectors which were associated with it are grouped together, and this generates a cluster of z vectors. So for every element in the codebook there is a cluster of z vectors. Once a cluster is formed, a "centroid" is calculated in block 4.

What "centroid" means will be explained in terms of a two-dimensional vector, although a vector in this invention may have a dimension of 40 or more. Suppose the two-dimensional codevectors are represented by two dots in space, with one dot placed at the origin. In the space of all two-dimensional vectors, there are N codevectors. In encoding the training sequence, the input could consist of many input vectors scattered all over the space. In a clustering procedure, all of the input vectors which are closest to one codevector are collected by bringing the various closest vectors to that one. Other input vectors are similarly clustered with other codevectors. This is the encoding process represented by blocks 2 and 3 in FIG. 6. The steps are to generate the input vectors and cluster them.

Next, a centroid is to be calculated for each cluster in block 4. A centroid is simply the average of all vectors clustered, i.e., it is that vector which will produce the smallest average distortion between all these input vectors and the centroid itself.

There is some distortion between a given input vector and a codevector, and there is some distortion between other input vectors and their associated codevector. If all the distortions associated with one codevector are summed together, a number will be generated representing the distortion for that codevector. A centroid can be calculated based on these input vectors by determining which will do a better job of reconstructing the input vectors than the original codevector. If it is the centroid, then the summation of the distortions between that centroid and the input vectors in the cluster will be minimum. Since this centroid could do a better job of representing these vectors than the original codevector, it is retained by updating the corresponding excitation codebook location in block 5. So this is the codevector ultimately retained in the excitation codebook. Thus, in this step of the codebook design procedure, the original Gaussian codevector is replaced by the centroid. In that manner, a new code-vector is generated.

For the specific case of VXC, the centroid derivation is based on the following set of conditions. Starting with a cluster of M elements, each consisting of a weighted speech vector $z_i$, a synthesis filter impulse response sequence $h_i$, and a speech model gain $G_i$, denote one $z_i$-$h_i(m)$-$G_i$ triplet as ($z_i$; $h_i$; $G_i$), $1 \leqq i \leqq M$. The objective is to find the centroid vector u for the cluster which minimizes the average squared error between $z_i$ and $G_iH_iu$, where $H_i$ is the lower triangular matrix described (Eq. 4).

The solution to this problem is similar to a linear-least squares result:

$$\sum_{i=1}^{M} G_i^2 H_i^T H_i\, u = \sum_{i=1}^{M} G_i H_i^T z_i. \tag{11}$$

Eq. (11) states that the optimal u is determined by separately accumulating a set of matrices and vectors corresponding to every ($z_i$; $h_i$; $G_i$) in the cluster, and then solving a standard linear algebra matrix equation (Ax=b).

For every codevector in the codebook, each cluster of codevectors has another centroid, so then another centroid is developed eliminating the previous as a codevector, thus constructing a codebook that will be better representative of this input training set than the original codebook. This procedure is repeated over and over, each time with a new codebook to encode the training sequence, calculate centroids and replace the codevectors with their corresponding centroids. That is the basic iterative procedure shown in FIG. 6. The idea is to calculate a centroid for each of the N codevectors, where N is the codebook size, then update the excitation codebook and check to see if convergence has been reached. If not, the procedure is repeated for all input vectors of the training sequence until convergence has been achieved. If not, the procedure may go back to block 2 (closed-loop iteration) or to block 3 (open-loop iteration). Then in block 6,the final codebook is center clipped to produce the pulse excitation codebook. That is the end of the pulse excitation codebook design procedure.

By eliminating the last step, wherein a pulse codebook is constructed (i.e., by retaining the design excitation codebook after the convergence test is satisfied), a codebook having fully populated codevectors may be obtained. Computer simulation results have shown that such a codebook will give superior performance compared to a Gaussian codebook of the same size.

A vector excitation speech coder has been described which achieves very high reconstructed speech quality at low bit-rates, and which requires 800 times less computation than earlier approaches. Computational savings are achieved primarily by incorporating fast-search techniques into the coder and using a smaller, optimized excitation codebook. The coder also requires less total codebook memory than previous designs, and is well-structured for real-time implementation using only one of today's programmable digital signal processor chips. The coder will provide high-quality speech coding at rates between 4000 and 9600 bits per second.

What is claimed is:

1. An improvement in the method for compressing digitally encoded speech or audio signal by using a permanent indexed codebook of N predetermined excitation vectors of dimension k, each having an assigned codebook index j to find indices which identify the best match between an input speech vector $s_n$ that is to be coded and a vector $c_j$ from a codebook, where the subscript j is an index which uniquely identifies a codevector in said codebook, and the index of which is to be associated with the vector code, comprising the steps of buffering and grouping said vectors into frames of L samples, with L/k vectors for each frame, performing initial analyses for each successive frame to determine a set of parameters for specifying long-term synthesis filtering, short-term synthesis filtering, and perceptual weighting, computing a zero-input response of a long-term synthesis filter, short-term synthesis filter, and perceptual weighting filter, perceptually weighting each input vector $s_n$ of a frame and subtracting from each input vector $s_n$ said zero input response to produce a vector $z_n$, obtaining each codevector $c_j$ from said codebook one at a time and processing each codevector $c_j$ through a scaling unit, said unit being controlled by a gain factor $G_j$, and further processing each scaled codevector $c_j$ through a long-term synthesis filter, short-term synthesis filter and perceptual weighting filter in cascade, said cascaded filters being controlled by said set of parameters to produce a set of estimates $\hat{z}_j$ of said vector $z_n$, one estimate for each codevector $c_j$, finding the estimate $\hat{z}_j$ which best matches the vector $z_n$, computing a quantized value of said gain factor $G_j$ using said vector $z_n$ and the estimate $\hat{z}_j$ which best matches $z_n$, pairing together the index j of the estimate $\hat{z}_j$ which best matches $z_n$ and said quantized value of said gain factor $G_j$ as index-gain pairs for later reconstruction of said digitally encoded speech or audio signal, associating with each frame said index-gain pairs from said frame along with the quantized values of said parameters otained by initial analysis for use in specifying long-term synthesis filtering and short-term synthesis filtering in said reconstruction of said digitally encoded speech or audio signal, and during said reconstruction, reading out of a codebook a codevector $c_j$ that is identical to the codevector $c_j$ used for finding said best estimate by processing said reconstruction codevector $c_j$ through said scalar and said cascaded long-term and short-term synthesis filters.

2. An improvement in the method for compressing digitally encoded speech as defined in claim 1 wherein said codebooks are made sparse by extracting vectors from an initial arbitrary codebook, one at a time, and setting all but a selected number of samples of highest amplitude values in each vector to zero amplitude values, thereby generating a sparse vector with the same number of samples as the initial vector, but with only said selected number of samples having nonzero values.

3. An improvement in the method for compressing digitally encoded speech as defined in claim 1 by use of a codebook to store vectors $c_j$, where the subscript j is an index for each vector stored, a method for designing an optimum codebook using an initial arbitrary codebook and a set of m speech training vectors sn by producing for each vector $s_n$ in sequence said perceptually weighted vector $z_n$, clustering said m vectors $z_n$, calculating N centroid vectors from said m clustered vectors, where $N<m$, update said codebook by replacing N vectors $c_j$ with vector $s_n$ used to produce vector $z_n$ found to be a best match with said vector $\hat{z}_j$ at index location j, and testing for convergence between the updated codebook and said set of m speech training vectors $s_n$, and if convergence has not been achieved, repeating the process using the updated codebook until convergence is achieved.

4. An improvement as defined in claim 3, including a final step of center clipping vectors in the last updated codebook vector by setting to zero all but a selected number of samples of lowest amplitude in each vector $c_j$, and leaving in each vector $c_j$ only said selected number of samples of highest amplitude by extracting the vectors of said last updated codebook, one at a time, and setting all but a selected number of samples of highest amplitude values in each vector to amplitude values of zero, thereby generating a sparse vector with the same number of samples as the last updated vector, but with only said selected number of samples having nonzero values.

5. An improvement as defined in claim 1 comprising a two-step fast search method wherein the first step is to classify a current speech frame prior to compressing by selecting one of a plurality of classes to which the current speech frame belongs, and the seocnd step is to use a selected one of a plurality of reduced sets of codevectors to find the best match been each input vector $z_i$ and one of the codevectors of said selected reduced set of codevectors having a unique correspondence between every codevector in the set and particular vectors in said permanent indexed codebook, whereby a reduced exhaustive search is achieved for processing each input vector $z_i$ of a frame by first classifying the frame and then using a reduced codevector set selected from the permanent index codebook for every input vector of the frame.

6. An improvement as defined in claim 5 wherein classification of each frame is carried out by examining the spectral envelope parameters of the current frame and comparing said spectral envelope parameters with stored vector parameters for all classes in order to select one of said plurality of reduced sets of codevectors.

7. An improvement as defined in claim 1, wherein the step of computing said quantized value of said gain factor $G_j$ and the estimate that best matches $z_n$ is carried out by calculating the cross-correlation between the estimate $\hat{z}_j$ and said vector $z_n$, and dividing the cross-correlation product of said vector $z_n$ and said estima $\hat{z}_j$ in accordance with the following equation:

$$G_j = \frac{\sum_{n=0}^{k=1} \hat{z}_j(n)z(n)}{\sum_{n=0}^{k=1} [\hat{z}_j(n)]^2}$$

where k is the number of samples in a vector.

8. An improvement in the method for compressing digitally encoded speech or audio signal by using a permanent indexed codebook of N predetermined excitation vectors of dimension k, each having an assigned codebook index j to find indices which identify the best match between an input speech vector $s_n$ that is to be coded and a vector $c_j$ from a codebook, where the subscript j is an index which uniquely identifies a codevector in said codebook, and the index of which is to be associated with the vector code, comprising the steps of designing said codebook to have sparse vectors by extracting vectors from an initial arbitrary codebook, one at a time, and setting to zero value all but a selected number of samples of highest amplitude values in each vector, thereby generating a sparse vector with the same number of samples as the initial vector, but with only said selected number of samples having nonzero values, buffering and grouping said vectors into frames of L samples, with L/k vectors for each frame, performing initial analyzes for each successive frame to determine a set of parameters for specifying long-term synthesis filtering, short-term synthesis filtering, and perceptual weighting, computing a zero-input response of a long-term synthesis filter, short-term synthesis filter, and perceptual weighting filter, perceptually weighting each input vector $s_n$ of a frame and subtracting from each input vector $s_n$ said zero input response to produce a vector $z_n$, obtaining each codevector $c_j$ from said codebook one at a time and processing each codevector $c_j$ through a scaling unit, said unit being controlled by a gain factor $G_j$, and further processing each scaled codevector $c_j$ through a long-term synthesis filter, short-term synthesis filter, said cascaded filters being controlled by said set of parameters to produce a set of estimates $\hat{z}_j$ of said vector $z_n$, one estimate for each codevector $c_j$, finding the estimate $\hat{z}_j$ which best matches the vector $z_n$, computing a quantized value of said gain factor $G_j$ using said vector $z_n$ and the estimate $\hat{z}_j$ which best matches $z_n$ pairing together the index j of the estimate $\hat{z}_j$ which best matches $z_n$ and said quantized value of said gain factor $G_j$ for later reconstruction of said digitally encoded speech or audio signal, associating with each frame said index-gain pairs from said frame along with the quantized values of said parameters obtained by initial analysis for use in specifying long-term synthesis filtering and short-term synthesis filtering in said reconstruction of said digitally encoded speech or audio signal, and during said reconstruction, reading out of a codebook a codevector $c_j$ that is identical codevector $c_j$ used for finding said best estimate by processing said reconstruction codevector $c_j$ through said scalar and said cascaded long-term and short-term synthesis filters.

9. An improvement in the method for compressing digitally encoded speech as defined in claim 8 by use of a codebook to store vectors $c_j$, where the subscript j is an index for each vector stored, a method for designing an optimum codebook using an initial arbitrary codebook and a set of m speech training vectors $s_n$ by producing for each vector $s_n$ in sequence said perceptually weighted vector $z_n$, clustering said m vectors $z_n$, calculating N centroid vectors from said m clustered vectors, where $N<m$, update said codebook by replacing N vectors $c_j$ with vector $s_n$ used to produce vector $z_n$ found to be a best match with said vector $z_j$ at index location j, and testing for convergence between the updated codebook and said set of m speech training vectors $s_n$, and if convergence has not been achieved, repeating the process using the updated codebook until convergence is achieved.

10. An improvement as defined in claim 9, including a final s of extracting the last updated vectors, one at a time, and setting to zero value all but a selected number of samples of highest amplitude values in each vector, thereby generating a sparse vector with the same number of samples as the last updated vetor, but with only said selected number of samples with nonzero values.

11. An improvement as defined in claim 8 comprising a fast search method using said codebook to select a number $N_c$ of good excitation vectors $c_j$, where $N_c$ is much smaller than N, and using said vectors $N_c$ for an exhaustive search to find the best match between said vector $z_n$ and estimate vector $z_j$ produced from a codevector $c_j$ included in said $N_c$ codebook vectors by precomputing N vectors $z_j$, comparing an input vector $z_n$ with vectors $z_j$, and producing a codebook of $N_c$ codevectors for use in an exhaustive search of the best match between said input vector $z_n$ and a vector $z_j$ from a codebook of $N_c$ vectors.

12. An improvement as defined in claim 11 wherein said $N_c$ codebook is produced by making rough classification of the gain-normalized spectral shape of a current speech frame into one of $M_s$ spectral shape classes, and selecting one of $M_s$ shaped codebooks for encoding an input vector $z_n$ by comparing said input vector with the $\hat{z}_j$ vectors stored in the selected one of the $M_s$ shaped codebooks, and then taking the $N_c$ condevectors which produce the $N_c$ smallest errors for use in said $N_c$ codebook.

* * * * *